United States Patent [19]

Furukawa

[11] Patent Number: 5,004,066

[45] Date of Patent: Apr. 2, 1991

[54] ACOUSTIC APPARATUS

[75] Inventor: Kazunari Furukawa, Hamamatsu, Japan

[73] Assignee: Yamaha Corporation, Hamamatsu, Japan

[21] Appl. No.: 330,470

[22] Filed: Mar. 30, 1989

[30] Foreign Application Priority Data

Apr. 4, 1988 [JP] Japan ..... 63-81343

[51] Int. Cl.[5] ..... H04R 7/00

[52] U.S. Cl. ..... 181/160; 181/156; 381/96; 381/159

[58] Field of Search ..... 181/141, 148, 155, 156, 181/160; 381/28, 93, 159, 94, 96, 98

[56] References Cited

U.S. PATENT DOCUMENTS

| | | | |
|---|---|---|---|
| 2,518,805 | 8/1950 | Mussa | 181/148 |
| 3,037,081 | 5/1962 | Carlsson | 181/148 X |
| 3,821,473 | 6/1974 | Mullins | 381/96 |
| 3,944,757 | 3/1976 | Tsukamoto | 381/160 X |
| 4,180,706 | 12/1979 | Bakgaard | 381/96 |
| 4,567,959 | 2/1986 | Prophit | 181/156 |
| 4,790,407 | 12/1988 | Yamamoto et al. | 181/141 |

FOREIGN PATENT DOCUMENTS

| | | | |
|---|---|---|---|
| 563658 | 6/1957 | Italy | 181/160 |

*Primary Examiner*—Benjamin R. Fuller
*Attorney, Agent, or Firm*—Spensley Horn Jubas & Lubitz

[57] ABSTRACT

In an acoustic apparatus in which a vibrator which drives a Helmholtz resonator having an open port by one surface thereof and directly radiates an acoustic wave from the other surface thereof is arranged in the Helmholtz resonator, the open port is arranged coaxially with the vibrator, and the vibrator is driven to cancel an air counteraction from the resonator when the resonator is driven. According to this construction, the acoustic apparatus can be rendered compact and the clear sound localization can be realized.

7 Claims, 5 Drawing Sheets

ACOUSTIC APPARATUS

BACKGROUND OF THE INVENTION

1. Field of the Invention

The present invention relates to an acoustic apparatus and, more particularly, to a compact acoustic apparatus which has clear sound localization and a novel outer appearance.

2. Description of the Prior Art

FIGS. 5A and 5B are respectively a elevation view and a sectional view showing an arrangement of the phase-inversion (bass-reflex) speaker system as one conventional acoustic apparatus. In the speaker system shown in FIGS. 5A and 5B, a hole is formed in the front surface of a cabinet 1, a vibrator (speaker unit) 4 consisting of a diaphragm 2 and a dynamic converter (speaker) 3 is mounted in the hole, and an open port 5 (so-called a bass-reflex port or resonance port) is formed therebelow. The open port 5 and the cavity of the cabinet 1 form a Helmholtz resonator. The open port 5 is formed into a tubular shape by a paper, plastic or wood material. Note that the open port 5 may be arranged on the rear surface of the cabinet 1, as shown in FIG. 6.

In the bass-reflex speaker system according to the conventional basic setting, a resonance frequency (Helmholtz resonance frequency $f_{OP}$ defined by an air spring of the cabinet 1 and an air mass in a sound path 6 of the open port 5 is set to be lower than a lowest resonance frequency $f_O$ of the vibrator 4 when the vibrator is assembled in the bass-reflex cabinet 1. At a frequency higher than the resonance frequency $f_{OP}$ defined by the air spring and the air mass, the phase of sound pressure from the rear surface of the diaphragm 2 is inverted at the open port 5. Consequently, in front of the cabinet 1, a sound directly radiated from the front surface of the diaphragm 2 is in phase with a sound from the open port 5 by resonance, and the sound pressure is increased. As a result, according to an optimally designed bass-reflex speaker system, the frequency characteristics of the output sound pressure can be expanded to the resonance frequency $f_O$ of the vibrator 4 or less. As indicated by an alternate long and two short dashed curve in FIG. 7, a uniform reproduction range can be widened as compared to an infinite plane baffle or closed baffle.

However, in the conventional bass-reflex speaker system, since independent spaces for respectively arranging the vibrator and the open port are set, a space factor is poor, and the speaker system cannot be easily reduced in size. In addition, a directly radiated sound from the vibrator and a resonantly radiated sound from the open port tend to serve as two sound sources, resulting in unclear sound localization.

An interval between the diaphragm and the open port is relatively small. For example, if this interval is smaller than a value three times an effective radius of the diaphragm of the vibrator, in-phase sounds radiated from the vibrator and the open port cancel each other, and hence, frequency characteristics, in particular, bass-sound characteristics are adversely influenced.

SUMMARY OF THE INVENTION

The present invention has been made in consideration of the above situation and has as its object to provide an acoustic apparatus which can provide a compact structure, good sound localization, and good bass-sound characteristics, and can allow a novel design.

In order to achieve the above object, according to the present invention, in an acoustic apparatus in which a vibrator which drives a Helmholtz resonator having an open port by its one surface and directly radiates an acoustic wave from the other surface is arranged in the Helmholtz resonator, the open port is arranged coaxially with the vibrator, and the vibrator is driven to cancel an air counteraction from the resonator side when the resonator is driven.

In this invention, a word "coaxial or coaxially" implies an actually coaxial state as well as a state wherein a plurality of ports are arranged at equal angular intervals on a circumference of a circle having an acoustic radiation axis of the vibrator as the center.

With the above arrangement according to the present invention, since the open port is arranged coaxially with the vibrator, an acoustic center of gravity of the open port coincides with the acoustic radiation axis of the vibrator, and sound localization is very good. When a plurality of open ports are arranged at given angular intervals on a circumference of a circle having the acoustic radiation axis of the vibrator as the center, since each port can be rendered compact, these ports can be arranged in an available vacant space, resulting in a high space factor. In this case, a resonance frequency $f_{OP}$ is determined by a total air mass of all the open ports and an air spring of a cabinet.

When the open port is arranged coaxially with the acoustic radiation axis of a speaker, i.e., when the open port is arranged to extend through the central portion of the speaker from the rear surface side to the front surface side, dimensions of the speaker system when viewed from a front side can be reduced to be almost equal to those of the vibrator. In addition, in a production process, the vibrator and the open port can be integrally handled, resulting in easy management.

When a bass-reflex speaker system is reduced in size, bass-sound characteristics are deteriorated since the volume of a cabinet is reduced. As described above, since a distance between the vibrator and the open port is decreased, the bass-sound characteristics are further deteriorated. However, according to the acoustic apparatus of the present invention, the vibrator is driven to cancel an air counteraction from the resonator side when the Helmholtz resonator is driven. That is, since the vibrator is driven in a so-called "dead" state without being influenced by the air counteraction from the resonator side, i.e., the cabinet side, the frequency characteristics of the directly radiated acoustic wave are not influenced by the volume of the cabinet. Therefore, the volume of the cabinet can be reduced as long as the cabinet can serve as a cavity of the Helmholtz resonator and a chamber of the vibrator. The vibrator is not influenced by the air counteraction caused by in-phase sounds. More specifically, two factors deteriorating the bass-sound characteristics when the open port is arranged coaxially with the vibrator to make the system compact are invalidated.

To drive the vibrator to cancel the air counteraction from the resonator side when the Helmholtz resonator is driven implies that the diaphragm of the vibrator becomes an equivalent wall since it cannot be driven by the resonator side when viewed from the resonator. Therefore, the Q value of the Helmholtz resonator is not influenced by the characteristics of the vibrator, and if the resonance frequency $f_{OP}$ is decreased, a sufficiently high Q value can be assured. Thus, according to the present invention, the system can be rendered compact and lower bass sounds can be reproduced. Since the Q value of the resonator is high, since the diaphragm can be driven at a small magnitude in a bass-sound range, the vibrator and the open port can radiate sounds including less distortion. On the other hand, the vibrator is sufficiently damped and is driven in a "dead" state. Therefore, the distortion characteristics of the vibrator are also good.

As described above, according to the present invention, a space factor can be improved, and the system can be rendered compact. When the system is rendered compact, characteristics of the vibrator and the resonator can be set regardless of the volume of the cabinet. Therefore, this is considerably advantageous in terms of manufacture and cost as compared to the conventional acoustic apparatus. In addition, sound localization is good. Furthermore, the speaker and the open port radiate less distorted sounds, and high-quality sounds can be obtained as a whole.

DETAILED DESCRIPTION OF THE PREFERRED EMBODIMENTS

Figure 5A:
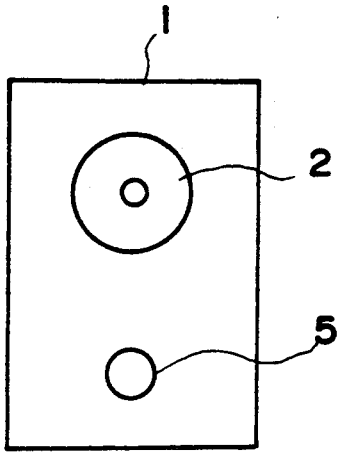
FIG. 5A PRIOR ART
FIGS. 5A and 5B are a front view and a sectional view showing an arrangement of a conventional bass-reflex speaker system.
Figure 5B:
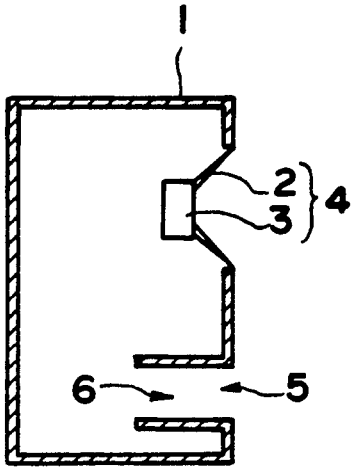
FIG. 5B PRIOR ART
Figure 6:
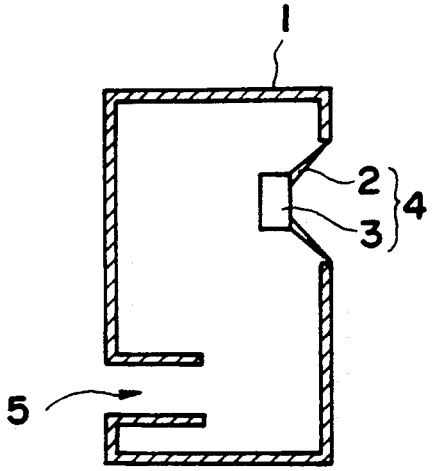
FIG. 6 PRIOR ART
FIG. 6 is a sectional view showing another prior art speaker system.

Preferred embodiments of the present invention will now be described with reference to FIGS. 1A to 4. Note that the same reference numerals in the following description denote the common or corresponding components in the prior art shown in FIGS. 5 and 6.

Figure 1A:
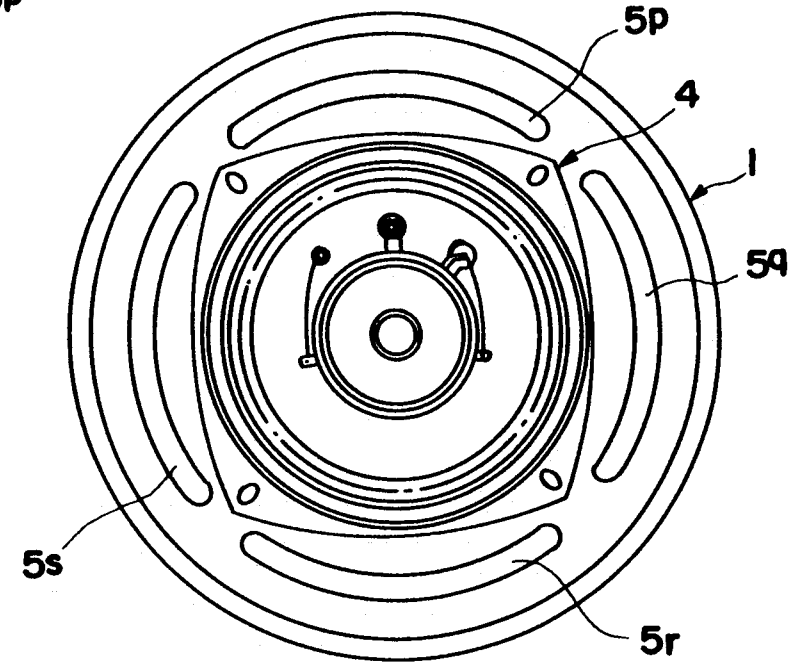
FIGS. 1A and 1B are views for explaining an arrangement of an acoustic apparatus according to an embodiment of the present invention.
Figure 1B:
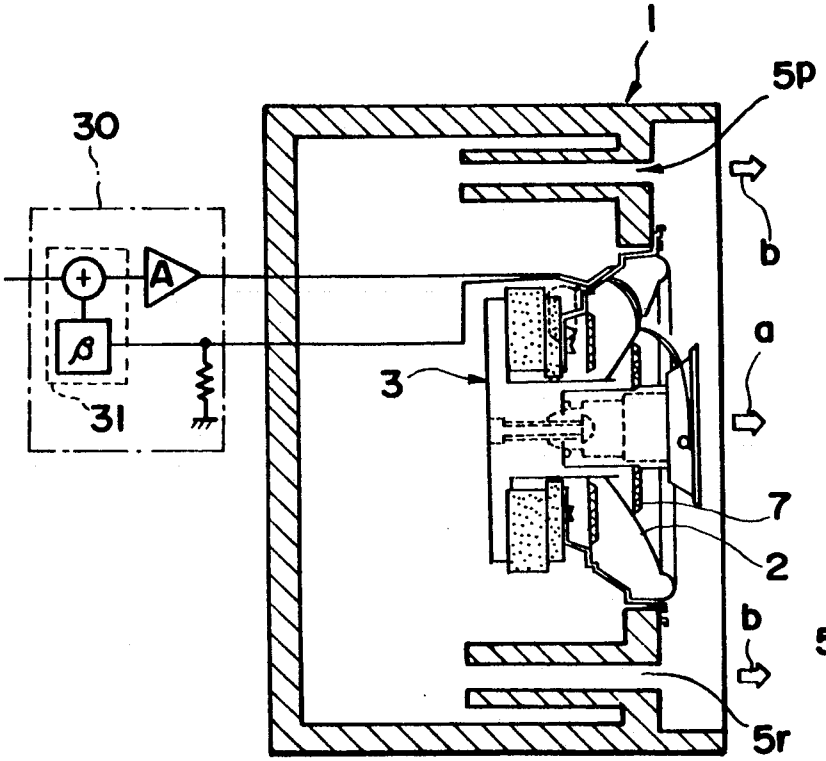

FIGS. 1A and 1B show an arrangement of an acoustic apparatus according to an embodiment of the present invention. In a system shown in FIGS. 1A and 1B, a hole is formed in the front surface of a cabinet 1, and a vibrator 4 consisting of a diaphragm 2 and a dynamic electro-acoustic converter 3 is mounted in the hole. Four open ports 5*p* to 5*s* each having an arcuated section substantially corresponding to a ¼ arc are arranged about the axis of the vibrator 4. These open ports 5*p* to 5*s* and the cabinet 1 form a Helmholtz resonator. Reference numeral 7 denotes a closed damper. In this Helmholtz resonator, an air resonance phenomenon is caused by an air spring of the cabinet 1 as a closed cavity, and a total air mass in the open ports 5*p* to 5*s*.

If the open ports 5*p* to 5*s* have a predetermined length l, a resonance frequency $f_{OP}$ is given by:

$$f_{OP}=c(S/lV)^{1/2}/2\pi \quad (1)$$

where c is the sonic sound, S is the sum of the sectional areas of the open ports 5*p* to 5*s*, and V is the volume of the cabinet 1. The dimensions of the cabinet 1 when viewed from the front side are smaller than dimensions twice those of the speaker diaphragm 2. More specifically, if the diaphragm has a diameter of 15 cm, the diameter of the cabinet 1 is about 27 cm. Thus, the system of this embodiment is very compact as compared to a conventional speaker system.

In this embodiment, the converter 3 is connected to a vibrator driver 30. The vibrator driver 30 comprises a servo unit 31 for performing an electrical servo so as to cancel an air counteraction from the resonator side when the Helmholtz resonator constituted by the cabinet 1 and the open ports 5*p* to 5*s* is driven. As the servo system, a known circuit, such as a negative impedance generator for equivalently generating a negative impedance component ($-Z_O$) in an output impedance, a motional feedback (MFB) circuit for detecting a motional signal corresponding to the behavior of the diaphragm 2 and negatively feeding back the signal to the input side by a proper means, or the like may be employed.

The operation of the acoustic apparatus shown in FIGS. 1A and 1B will be described below.

When a drive signal is supplied from the vibrator driver 30 to the converter 3, the converter 3 electromechanically converts the drive signal to reciprocate the diaphragm 2 in the back-and-forth direction (right-and-left direction in FIG. 1). The diaphragm 2 mechanical acoustically converts the reciprocal movement The front surface side (right side in FIG. 1B) of the diaphragm 2 constitutes direct radiation portion for directly externally radiating an acoustic wave, and the rear surface side (left surface side in FIG. 1B) of the diaphragm 2 constitutes a resonator driving portion for driving the Helmholtz resonator constituted by the cabinet 1 and the open ports 5*p* to 5*s*. Although an air counteraction from the air in the cabinet 1 acts on the rear surface side of the diaphragm 2, the vibrator driver 30 drives the converter 3 to cancel the air counteraction.

In this manner, since the converter 3 is driven to cancel the air counteraction from the resonator when the Helmholtz resonator is driven, the diaphragm 2 cannot be driven from the side of the resonator, and serves as a rigid body, i.e., a wall. Therefore, the resonance frequency and the Q value of the Helmholtz resonator are independent from those of the direct radiation portion constituted by the diaphragm 2 and the converter 3, and the resonator drive energy from the converter 3 is given independently of the direct radiation portion. Since the converter 3 is driven in a so-called "dead" state wherein it is not influenced by the air counteraction from the resonator, i.e., the cabinet 1, the frequency characteristics of a directly radiated acoustic wave are not influenced by the volume of the cabinet 1. Therefore, according to the arrangement of this embodiment, if the volume of the cabinet 1 as the cavity of the Helmholtz resonator is reduced to be smaller than the conventional bass-reflex speaker system and at the same time, the resonance frequency $f_{OP}$ is set to be lower than that of the conventional bass-reflex speaker system, a sufficiently high Q value can be set. As a result, in the system shown in FIGS. 1A and 1B, although the cabinet 1 is considerably reduced in size as compared to the bass-reflex speaker system, reproduction of lower bass sounds can be performed.

Figure 2:
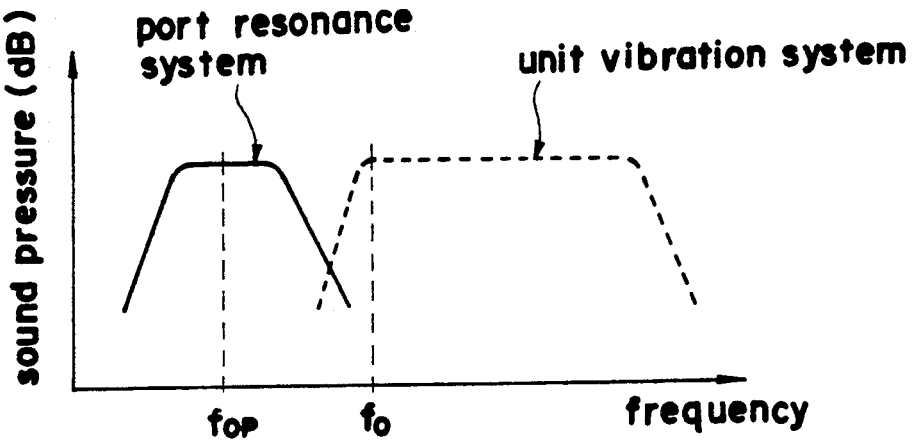
FIG. 2 is a graph for explaining sound pressure characteristics of the embodiment shown in FIG. 1.
Figure 7:
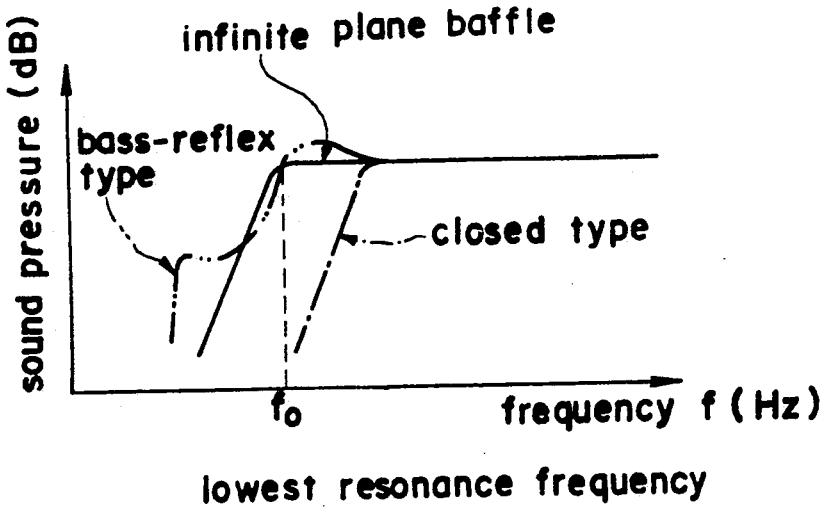
FIG. 7 PRIOR ART
FIG. 7 is a graph for explaining sound pressure characteristics of the speaker system shown in FIGS. 5 and 6.

In FIGS. 1A and 1B, the converter 3 drives the diaphragm 2 in response to the drive signal from the vibrator driver 30, and independently supplies drive energy to the Helmholtz resonator constituted by the cabinet 1 and the open ports 5*p* to 5*s*. Thus, an acoustic wave is directly radiated from the diaphragm 2 as indicated by an arrow a in FIG. IB. At the same time, air in the cabinet 1 is resonated, and an acoustic wave having a sufficient sound pressure can be resonantly radiated from the resonance radiating portion (open ports 5*p* to 5*s*) as indicated by an arrow b in FIG. 1B. By adjusting an air equivalent mass in the open ports 5*p* to 5*s* in the Helmholtz resonator, the resonance frequency $f_{OP}$ is set to be lower than a reproduction frequency range of the converter 3, and by adjusting an equivalent resistance of the open ports 5*p* to 5*s* to set the Q value to be an optimal level, a sound pressure of a proper level can be obtained from the open ports 5*p* to 5*s*. Under these conditions, the frequency characteristics of a sound pressure shown in, e.g., FIG. 2 can be obtained. In FIG. 2, solid curves represent frequency characteristics of resonantly radiated acoustic sound pressure from the open ports 5*p* to 5*s*, and broken curves represent frequency characteristics of directly radiated acoustic sound pressure from the vibrator 4.

Figure 3A:
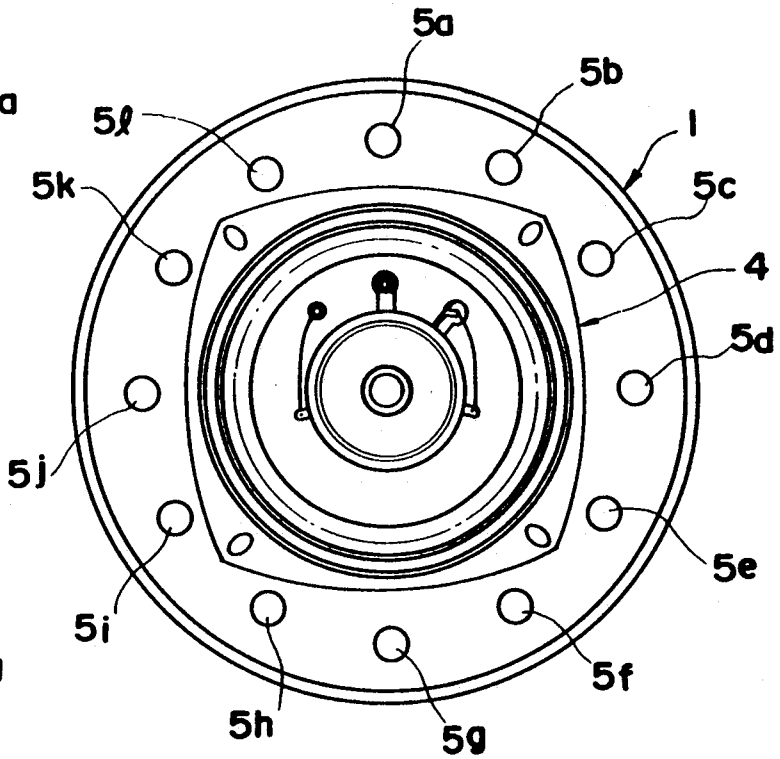
FIGS. 3A and 3B and FIG. 4 are views for explaining an arrangement of an acoustic apparatus according to other embodiments of the present invention.
Figure 3B:
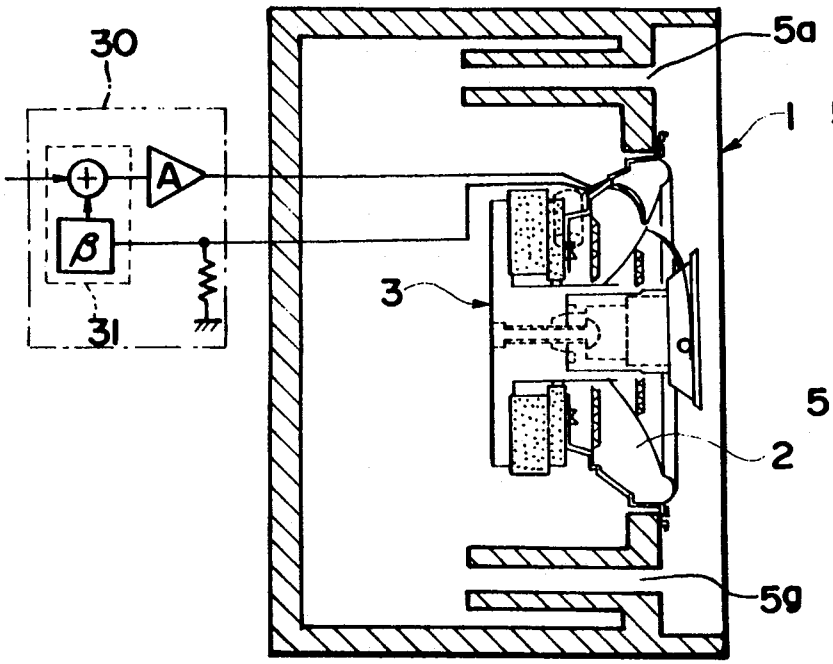
Figure 4:
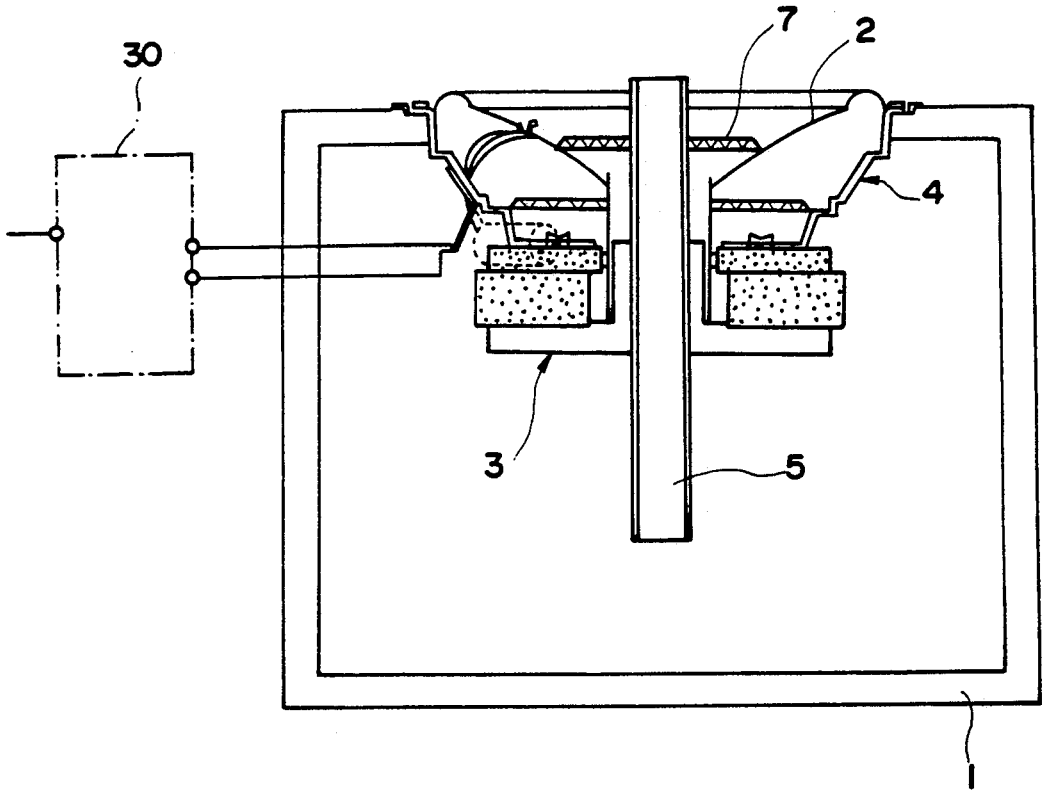

FIGS. 3A and 3B and FIG. 4 show other embodiments of the present invention.

In a system shown in FIGS. 3A and 3B, open ports are further divided, i.e., 12 ports are arranged. These 12 open ports 5*a* to 5*l* are arranged at 30° angular intervals on a circumference of a circle having the acoustic radiation axis of a vibrator 4 as the center. Note that when a plurality of open ports are arranged on a circumference of a circle having the acoustic radiation axis of the vibrator 4 as the center, angular intervals of the open ports need not always be equal to each other. However, the acoustic center of gravity of all the open ports is preferably caused to coincide with the acoustic radiation axis. When an even number of (two or more) open ports having an identical shape are arranged, they can be arranged symmetrical about two orthogonal planes passing through the acoustic radiation axis, so that the acoustic center of gravity can be caused to coincide with the acoustic radiation axis. The vibrator is driven by the vibrator driver 30 (not shown) in the same manner as in FIG. 1.

FIG. 4 shows a case wherein a single open port is arranged to extend through the center of the vibrator 4 from the front surface side to the rear surface side. In this case, a space required for arranging the open port is the same as that required for arranging the vibrator. Thus, the space for the open port can be saved, and the size of the cabinet 1 can be further reduced as compared to those shown in FIGS. 1 and 3.

What is claimed is:

1. An acoustic apparatus, comprising:

a cabinet having an internal cavity defining a Helmholtz resonator having an open port therein;

a vibrator arranged in said Helmholtz resonator, said vibrator having one surface which drives said Helmholtz resonator and having another surface which directly radiates an acoustic wave, wherein said open port is arranged coaxially with said vibrator; and a vibrator driver for driving said vibrator to cancel air counteraction from said resonator when said resonator is driven.

2. An acoustic apparatus according to claim 1, wherein a plurality of said open ports are arranged at equal angular intervals on a circumference of a circle having a center that coincides with an acoustic center of the vibrator.

3. An acoustic apparatus, comprising:

a cabinet having a closed cavity and an open port through which the closed cavity communicates with air surrounding the closed cavity, the closed cavity and the open port defining a Helmholtz resonator;

a vibrator forming a part of the closed cavity, the vibrator having an inner surface for driving the resonator and an external surface for directly radiating acoustic waves, the open port being arranged coaxially with respect to the vibrator; and a vibrator driver, operatively coupled to the vibrator, for supplying an electrical signal to the vibrator and for cancelling the air counteraction of the resonator.

4. An acoustic apparatus according to claim 3, wherein the open port includes a plurality of open ports arranged at equal angular intervals on a circumference of a circle whose center that coincides with an acoustic radiation axis of the vibrator.

5. An acoustic apparatus according to claim 3, wherein the open port is a single open port arranged to extend through an acoustic radiation axis of the vibrator.

6. An acoustic apparatus according to claim 3, wherein the vibrator driver includes an amplifier having a negative output impedance approximately equal to the value of an internal impedance of the vibrator.

7. An acoustic apparatus according to claim 3, wherein the closed cavity includes a front wall, the vibrator and open port being disposed on the front wall, so that the vibrator and open port emanate acoustic waves in the same direction.

* * * * *